US005532099A

United States Patent [19]

Horie et al.

[11] Patent Number: 5,532,099

[45] **Date of Patent: * Jul. 2, 1996**

[54] LIQUID DEVELOPER FOR ELECTROSTATIC PHOTOGRAPHY

[75] Inventors: Seiji Horie; Kenji Sano; Nobuo Suzuki; Shu Watarai, all of Kanagawa, Japan

[73] Assignee: Fuji Photo Film Co., Ltd., Kanagawa, Japan

[ * ] Notice: The term of this patent shall not extend beyond the expiration date of Pat. No. 5,344,694.

[21] Appl. No.: 372,883

[22] Filed: Jan. 13, 1995

Related U.S. Application Data

[63] Continuation of Ser. No. 2,029, Jan. 8, 1993, abandoned.

[30] Foreign Application Priority Data

Jan. 10, 1992 [JP] Japan ..... 4-020786

[51] Int. Cl.[6] ..... G03G 9/13; G03G 9/135

[52] U.S. Cl. ..... 430/115; 430/137

[58] Field of Search ..... 430/115, 904, 430/137

[56] References Cited

U.S. PATENT DOCUMENTS

| | | | |
|---|---|---|---|
| 5,108,864 | 4/1992 | Kato et al. | 430/115 |
| 5,112,718 | 5/1992 | Kato et al. | 430/115 |
| 5,344,694 | 9/1994 | Horie et al. | 430/115 |

OTHER PUBLICATIONS

Grant, Roger, and Claire Grant, editors, *Grant and Hackh's Chemical Dictionary,* fifth ed. New York: McGraw–Hill, Inc., 1987, p. 331.

*Primary Examiner*—Christopher D. Rodee

*Attorney, Agent, or Firm*—Sughrue, Mion, Zinn, Macpeak & Seas

[57] ABSTRACT

A liquid developer for electrostatic photography comprising resin grains dispersed in a non-aqueous solvent having a volume specific resistivity of at least $10^9$ Ωcm, wherein the resin grains are obtained by polymerizing (a) at least one monomer selected from methyl methacrylate and ethyl methacrylate soluble in said non-aqueous solvent and (b) at least one monomer selected from acrylic acid esters and methacrylic acid esters having an alkyl group having not more than 4 carbon atoms which are soluble in the non-aqueous solvent but become insoluble therein by being polymerized, in the presence of a dispersion stabilizing resin which is dissolved or dispersed in a colloidal form in the non-aqueous solvent and which mainly comprises a graft copolymer composed of (1) at least one macromonomer (M) having a weight-average molecular weight of $1\times10^3$ to $1\times10^5$, and having a polymerizable double bond group bonded to one terminal of the main chain of the polymer composed of at least one of a styrene polymer component and a polymer component of formula (I) defined above, and (2) at least one monomer represented by formula (III) defined above.

The liquid developer is excellent in dispersion stability, and toner images having resist with high resistivity to etching solutions can be formed in electrostatic photography.

6 Claims, No Drawings

LIQUID DEVELOPER FOR ELECTROSTATIC PHOTOGRAPHY

This is a Continuation of application Ser. No. 08/002,029, abandoned, filed Jan. 8, 1993.

FIELD OF THE INVENTION

The present invention relates to a liquid developer used for development of electrostatic latent images and more particularly to a liquid developer for electrostatic photography for use in the making of a printing plate by using a printing plate precursor comprising an organic photoconductive compound layer provided on an electrically conductive substrate having a hydrophilic surface, forming a toner image with a liquid developer by electrophotography, fixing it and etching the plate with an aqueous alkaline etching solution to remove non-image areas other than image areas.

BACKGROUND OF THE INVENTION

Various liquid developers for electrostatic photography have hitherto been known, for example, a liquid developer as disclosed in Metcalfe et al., U.S. Pat. No. 2,907,674. Generally, the liquid developer is prepared by mechanically dispersing a pigment or dye such as carbon black, phthalocyanine blue or nigrosine, and a resin such as an alkyd resin, an acrylic resin, rosine, a synthetic rubber, in a solvent having a high electric insulating property using a ball mill, an attritor or a homogenizer, and further adding thereto a charge controlling agent such as a metal soap, lecithin, linseed oil, and a higher fatty acid.

However, the liquid developers obtained by the above-described method generally have problems such as occurrence of precipitates and poor dispersion stability and charge stability due to broad distribution of particle size of the developer. In order to improve the dispersion stability, a liquid developer prepared by using a graft copolymer containing a unit formed from a macromonomer having a molecular weight from $1\times10^3$ to $2\times10^4$ as a dispersion stabilizing resin is disclosed in U.S. Pat. No. 5,112,718. Further, when the liquid developer is used for development of printing plates and for forming a toner image which is used as a resist layer, most of the conventional liquid developers are not satisfactory in the resolving power, resistivity and printing durability.

The formation of the toner image which is used as a resist layer from a liquid developer for electrostatic photography is described hereinafter in detail.

Conventional printing plate materials (printing plates precursors) which utilize electrophotography include zinc oxide-resin dispersion system offset printing materials as described in JP-B-47-47610 (the term "JP-B" as used herein means an "examined Japanese patent publication"), JP-B-48-40002, JP-B-48-18325, JP-B-51-15766 and JP-B-51-25761. These printing plate materials are used after a toner image is formed by an electrophotographic process and the non-image areas are wetted with a desensitizing solution (e.g., an aqueous acid solution containing a ferrocyanate or a ferricyanate) to desensitize the areas. The thus processed offset printing plates have a printing durability of about 5,000 to 10,000 prints and are unsuitable for more printing. When the compositions of these plates are designed so as to be suitable for the desensitization processing, there are disadvantages that electrostatic characteristics are deteriorated and image quality becomes poor.

Many organic photoconductive material-resin system printing plate materials are known. Examples of such printing plate materials include those described in JP-B-37-17162, JP-B-38-7758, JP-B-46-39405, JP-A-52-24375 (the term "JP-A" as used herein means an "unexamined published Japanese patent application") and JP-B-2-46944. In these printing plates, a styrene-maleic anhydride copolymer, a vinyl acetate-crotonic acid copolymer, a vinyl acetate-maleic anhydride copolymer or a phenolic resin is used as a binder for organic photoconductive materials, said copolymers being soluble in alkalis and/or alcohols. The copolymer together with an organic photoconductive compound is coated on an electrically conductive metallic substrate such as an aluminum sheet to form a sensitive material. The material is subjected to a corona discharge treatment, an exposure treatment and a toner development processing to form a toner image. Non-image areas other than the toner image areas are removed by etching with an aqueous alkaline etching solution, whereby a printing plate can be made wherein the surface of the hydrophilic metallic substrate corresponding to the non-image areas is exposed by etching. As the organic photoconductive material-resin system printing plates according to this system, printing plates which are available under trade name of Elefasol from Curry Co., are put to practical use. However, the Elefasol system is a system wherein a toner image is formed with a dry developer. Even when fine toner grains are used as the dry developer, printing plates giving images having poor resolving power of only about 3 to 5 lines/mm can be obtained.

On the other hand, when a toner image is formed by using a liquid developer, there can be obtained an image having a resolving power of about 15 to 50 lines/mm.

When the liquid developer is used, a toner image excellent in resolving power can be obtained and a sharp image can be obtained. However, there are disadvantages that the thickness of the toner image is considerably thinner than that of the dry system image and the toner image is inferior to the dry system image in the property as a resist in etching solutions and as a result, the resulting printing plate has poor printing durability.

Generally, it is required that liquid developers for printing plates have such characteristics that the developers are excellent in dispersion stability, redispersibility and fixability in addition to the excellent property as a resist (resistivity) to the etching solutions. Many liquid developers for printing plates have been conventionally developed and proposed. However, the fact is that there is not proposed any liquid developer which is considered to have all of the desired characteristics with regard to resolving power, dispersion stability, redispersibility, fixability and the property as a resist.

SUMMARY OF THE INVENTION

An object of the present invention is to provide a liquid developer which has satisfactory grain size distribution and excellent dispersion stability and charge stability.

Another object of the present invention is to provide a liquid developer which forms a toner image having a high resistivity to aqueous alkaline etching solutions in the making of printing plates.

Still another object of the present invention is to provide a liquid developer for the printing plates which has excellent dispersion stability and is good for long-term use and long-term storage.

A further object of the present invention is to provide a liquid developer for the printing plates which is suitable for use in the making of lithographic plates for electrophotography which gives images having excellent resolving power, can well reproduce images and has good printing durability.

The above-described objects of the present invention can be achieved by a liquid developer for electrostatic photography comprising at least resin grains dispersed in a non-aqueous solvent having a volume specific resistance of at least $10^9$ Ωcm, wherein the resin grains are obtained by polymerizing (a) at least one monomer selected from methyl methacrylate and ethyl methacrylate soluble in the non-aqueous solvent, and (b) at least one monomer selected from acrylic acid esters and methacrylic acid esters each having an alkyl group having not more than 4 carbon atoms which are soluble in the non-aqueous solvent but become insoluble therein by being polymerized, in the presence of a dispersion stabilizing resin which is dissolved or dispersed in a colloidal form in the non-aqueous solvent and which mainly comprises a graft copolymer composed of (1) at least one macromonomer (M) having a weight average molecular weight of from $1\times10^3$ to $1\times10^5$ and having a polymerizable double bond group represented by the general formula (II) below bonded at a terminal of the main chain of a polymer composed of at least one of a styrene polymer component and a polymer component represented by the general formula (I) described below, and (2) at least one monomer represented by the general formula (III) below;

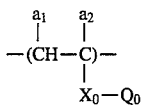

(I)

wherein $X_0$ represents at least one linking group selected from —COO—, —OCO—, —$(CH_2)_k$—OCO—, —$(CH_2)_k$—COO—, —O—, —CONHCOO—, —CONHCO—, —$SO_2$—, —CO—,

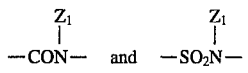

(wherein $Z_1$ represents a hydrogen atom or a hydrocarbon group, and k represents an integer of 1 to 3); $a_1$ and $a_2$, which may be the same or different, each represents a hydrogen atom, a halogen atom, a cyano group, a hydrocarbon group, —COO—$Z_2$ or —COO—$Z_2$ bonded via a hydrocarbon group (wherein $Z_2$ represents a hydrogen atom or a hydrocarbon group which may be substituted); and $Q_0$ represents an aliphatic group having from 1 to 3 carbon atoms;

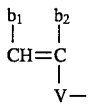

(II)

wherein V represents —COO—, —OCO—, —$(CH_2)_k$—OCO—, —$(CH_2)_k$—COO—, —O—, —CONHCOO—, —CONHCO—, —$SO_2$—, —CO—,

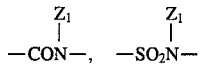

or a phenylene group (hereinafter referred to as Ph, wherein Ph includes 1,2-, 1,3- and 1,4-phenylene groups) (wherein $Z_1$ represents a hydrogen atom or a hydrocarbon group, and k represents an integer of from 1 to 3); and $b_1$ and $b_2$, which may be the same or different, have the same meanings as $a_1$ and $a_2$ defined in the general formula (I); and

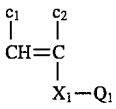

(III)

wherein $X_1$ has the same meaning as $X_0$ defined in the general formula (I), $Q_1$ represents an aliphatic group having from 4 to 22 carbon atoms, and $c_1$ and $c_2$, which may be the same or different, have the same meanings as $a_1$ and $a_2$ defined in the general formula (I).

The liquid developer for electrostatic photography according to the present invention can be used for making a printing plate by image on a electrophotographically forming a toner printing plate precursor comprising an electrically conductive substrate having a hydrophilic surface and a layer containing an organic photoconductive compound provided on the hydrophilic surface of the substrate using the liquid developer, fixing the toner image, and removing a non-image area of the layer other than the toner image area by etching with an alkaline etching solution.

DETAILED DESCRIPTION OF THE INVENTION

The non-aqueous solvent for use in the liquid developer according to the present invention preferably has a volume specific resistance of at least $10^9$ Ωcm and a dielectric constant of not higher than 3.

Now, methods for preparing a liquid developer having an excellent positive charge stability from the copolymer resin grain are described below.

The first method for preparing a positive charge liquid developer comprises using a macromonomer which is produced by bonding a terminal carboxyl group of the main chain of a polymer containing at least one polymer component represented by the general formula (I) above and an epoxy compound having a polymerizable double bond group by using a tertiary amine or a quaternary ammonium salt as a reaction catalyst, in the production of the dispersion stabilizing resin which mainly comprises a graft copolymer and which is dissolved or dispersed in a colloidal form in the non-aqueous solvent.

More specifically, the first method comprises obtaining a positively chargeable liquid developer comprising the resin grain dispersed in the non-aqueous solvent by polymerizing the monomers which are soluble in the non-aqueous solvent but become insoluble therein by being polymerized, in the presence of the dispersion stabilizing resin mainly composed of a graft copolymer synthesized by using a tertiary amine or a quaternary ammonium salt as a reaction catalyst.

The second method for preparing a positively chargeable liquid developer comprises adding the above-described dispersion stabilizing resin mainly composed of the graft copolymer to a dispersion of the resin grain.

More specifically, the second method comprises obtaining a positively chargeable liquid developer by adding the dispersion stabilizing resin used in the first method to a non-aqueous dispersion of the resin grain obtained by polymerizing the monomers which are soluble in the non-aqueous solvent but become insoluble therein by being polymerized, in the dispersion stabilizing resin mainly composed of the graft copolymer comprising the macromonomer having the above formula synthesized without using a tertiary amine or a quaternary ammonium salt as a catalyst.

In the above-described second method, the amount of the dispersion stabilizing resin to be added which is mainly composed of the graft copolymer comprising the macromonomer synthesized by using the tertiary amine or quaternary ammonium salt catalyst is from 0.1 to 20 parts by weight, preferably from 1 to 10 parts by weight, per 10 parts by weight of the resin content in the dispersion of the resin grain.

The third method for preparing the positively chargeable liquid developer comprises introducing an ingredient which is capable of providing a positive charge to a toner grain and receiving ions by adding a charge controlling material to generate a charge.

The monomer component (c) which provides a positive charge to the toner particles corresponds to a monomer which is copolymerizable with at least one monomer selected from each of (a) methyl methacrylate or ethyl methacrylate, and (b) an acrylic acid ester or a methacrylic acid ester each having an alkyl group having not more than 4 carbon atoms, and includes vinyl monomers having a basic nitrogen atom or an amido group.

Examples of the vinyl monomers having basic nitrogen atom or an amido group include aminoalkyl-substituted (meth)acrylates represented by the following general formula (IV), quaternary salts of aminoalkyl-substituted (meth-)acrylates represented by the following general formula (V), N-vinylimidazole, N-vinyl-2-methylimidazole, 1-vinylpyrrole, N-β-acryloxyethylindole, 2-vinylquinoline, 4-vinylpyridine, 5-vinyl-4-methylthiazole, 3-methyl-5-isopropenylpyrazole, N-vinyl-2-pyrrolidone, N-vinylpiperidone, N-vinyloxazolidone, dimethylaminostyrene, dialkylaminomethylstyrenes, quaternary salts of dialkylaminomethylstyrenes and (meth)acrylamide.

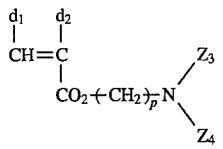

(IV)

In general formula (IV), $d_1$ and $d_2$ may be the same or different and each represents hydrogen atom or methyl group; $Z_3$ and $Z_4$ may be the same or different and each has the same meaning as $Z_1$ defined above; p represents an integer of 1 to 3.

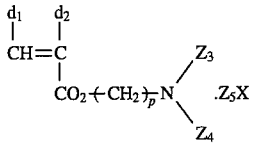

(V)

In general formula (V), $d_1$, $d_2$, p, $Z_3$ and $Z_4$ are as defined above in general formula (IV); $Z_5$ represents an alkyl group having 1 to 18 carbon atoms or an aralkyl group having 7 to 24 carbon atoms; and X represents a halogen atom (e.g., fluorine, chlorine, bromine or iodine), an acetate, $BF_4$, a sulfate, p-toluenesulfonate or an alkylsulfonate.

The liquid developer of the present invention is described hereinafter in detail.

The liquid carrier used in the liquid developer of the present invention is a non-aqueous solvent having an electric resistance (volume specific resistance) of at least $10^9$ Ωcm, and preferably non-aqueous solvents having an electric resistance of at least $10^9$ Ωcm and a dielectric constant of not higher than 3. The non-aqueous solvent includes straight chain or branched aliphatic hydrocarbons, alicyclic hydrocarbons, aromatic hydrocarbons and halogen-substituted compounds thereof. Specific examples thereof include octane, isooctane, decane, isodecane, decalin, nonane, dodecane, isododecane, cyclohexane, cyclooctane, cyclodecane, benzene, toluene, xylene, mesitylene, Isopar E, Isopar G, Isopar H, Isopar L (Isopar is the trade name of Exxon Co.), Shellsol 70, Shellsol 71 (Shellsol is the trade name of Shell Oil Co.), Amsco OMS and Amsco 460 solvent (Amsco is the trade name of American Mineral Spirits Co.). These solvents may be used singly or as a combination thereof.

The non-aqueous solvent dispersed resin grains (hereinafter often referred to as latex grains) which are important components of the present invention are produced by polymerizing (i.e., polymerization granulation) the monomers mainly comprising the monomers, at least one of each of which monomers is selected from (a) methyl methacrylic acid or ethyl methacrylic acid, and (b) an acrylic acid ester or a methacrylic acid ester each having an alkyl group containing not more than 4 carbon atoms, in the presence of the dispersing agent of the above-described graft type copolymer in the non-aqueous solvent.

Basically, any non-aqueous solvents can be used as long as they are miscible with the liquid carrier used in the liquid developers for electrostatic photography.

That is, any solvents may be used in producing the dispersed resin grains as long as they are miscible with the above-described liquid carrier. Preferred examples of such solvents include straight chain or branched aliphatic hydrocarbons, alicyclic hydrocarbons, aromatic hydrocarbons and halogen-substituted compounds thereof, for example, hexane, octane, isooctane, decane, isodecane, decalin, nonane, dodecane, isododecane, Isopar E, Isopar G, Isopar H, Isopar L, Shellsol 70, Shellsol 71, Amsco OMS and Amsco 460 solvents. These solvents may be used singly or as a combination thereof.

Solvents which can be used together with these organic solvents include alcohols (such as methyl alcohol, ethyl alcohol, propyl alcohol, butyl alcohol and fluorinated alcohol); ketones (such as acetone, methyl ethyl ketone and cyclohexanone); carboxylic acid esters (such as methyl acetate, ethyl acetate, propyl acetate, butyl acetate, methyl propionate and ethyl propionate); ethers (such as diethyl ether, dipropyl ether, tetrahydrofuran and dioxane); and halogenated hydrocarbons (such as methylene dichloride, chloroform, carbon tetrachloride, dichloroethane and methylchloroform).

It is preferred that the non-aqueous solvents which are used as a mixture thereof are distilled off by heating or under reduced pressure after completion of polymerization granulation. However, even if the non-aqueous solvent is brought in the liquid developer as a latex grain dispersions, the solvent gives no problem as long as the liquid electric resistance of the liquid developer is in the range of satisfying the condition of at least $10^9$ Ω.cm.

In general, it is preferred to use solvents similar to the liquid carrier in the stage of producing the resin dispersion, and, as described above, the solvent to be used is selected from the straight or branched chain aliphatic hydrocarbons, alicyclic hydrocarbons, aromatic hydrocarbons and halogenated hydrocarbons thereof.

The graft copolymers are further described below.

The macromonomer (M) is a macromonomer having a weight average molecular weight of from $1\times10^3$ to $1\times10^5$ obtained by bonding a polymerizable double bond group represented by the general formula (II) which is copolymerizable with the monomer represented by the general formula (III) to one terminal of the main chain of the styrene polymer or the polymer composed of the repeating unit represented by the general formula (I).

Monomers which constitute the styrene polymer include styrene, alkylated styrenes such as methylstyrene, ethylstyrene and t-butylstyrene (the substituting position may be any of o-, m- and p-positions), and halogenated styrenes such as monochlorostyrene, dichlorostyrene, monobromostyrene and dibromostyrene (the substituting position(s) may be any of o-, m- and p-positions). The styrene polymer may be composed of a single monomer or a combination of monomers.

In the general formulae (I), (II) and (III), the hydrocarbon group represented by $a_1$, $a_2$, $b_1$, $b_2$, V, $X_0$, $X_1$, $Q_0$ and $Q_1$ each has the indicated carbon numbers in the case of an unsubstituted hydrocarbon group, and these hydrocarbon groups may be substituted.

In the general formula (I), $X_0$ represents —COO—, —OCO—, $-(CH_2)_k-OCO-$, $-(CH_2)_k-COO-$, —O—, —CONHCOO—, —CONHCO—, $-SO_2-$, —CO—, $$-\overset{\overset{Z_1}{|}}{C}ON- \quad \text{or} \quad -SO_2\overset{\overset{Z_1}{|}}{N}-,$$

wherein $Z_1$ represents a hydrogen atom or a hydrocarbon group, and k represents an integer of 1 to 3.

Preferred examples of the hydrocarbon groups include an alkyl group having from 1 to 22 carbon atoms which may be substituted (for example, methyl, ethyl, propyl, butyl, heptyl, hexyl, octyl, decyl, dodecyl, tridecyl, tetradecyl, hexadecyl, octadecyl, 2-chloroethyl, 2-bromoethyl, 2-cyanoethyl, 2-methoxycarbonylethyl, 2-methoxyethyl and 2-bromopropyl); an alkenyl group having from 4 to 18 carbon atoms which may be substituted (for example, 2-methyl-1-propenyl, 2-butenyl, 2-pentenyl, 3-methyl-2-pentenyl, 1-pentenyl, 1-hexenyl, 2-hexenyl and 4-methyl-2-hexenyl); an aralkyl group having from 7 to 12 carbon atoms which may be substituted (for example, benzyl, phenethyl, 3-phenylpropyl, naphthylmethyl, 2-naphthylethyl, chlorobenzyl, bromobenzyl, methylbenzyl, ethylbenzyl, methoxybenzyl, dimethylbenzyl and dimethoxybenzyl); an alicyclic group having from 5 to 8 carbon atoms which may be substituted (for example, cyclohexyl, 2-cyclohexylethyl and 2-cyclopentylethyl); an aromatic group having from 6 to 12 carbon atoms which may be substituted (for example, phenyl, naphthyl, tolyl, xylyl, propylphenyl, butylphenyl, octylphenyl, dodecylphenyl, methoxyphenyl, ethoxyphenyl, butoxyphenyl, decyloxyphenyl, chlorophenyl, dichlorophenyl, bromophenyl, cyanophenyl, acetylphenyl, methoxycarbonylphenyl, ethoxycarbonylphenyl, butoxycarbonylphenyl, acetamidophenyl, propioamidophenyl and dodecyloylamidophenyl); and a cross-linked hydrocarbon group having from 5 to 18 carbon atoms (for example, bicyclo[1,1,0]butane, bicyclo[3,2,11octane, bicyclo[5,2,0] nonane, bicyclo[4,3,2]-undecane and adamantane).

$a_1$ and $a_2$, which may be the same or different, each preferably represents a hydrogen atom, a halogen atom (for example, a chlorine atom or a bromine atom), a cyano group, an alkyl group having from 1 to 3 carbon atoms (for example, methyl, ethyl or propyl), $-COO-Z_2$ or $-CH_2COOZ_2$ (wherein $Z_2$ preferably represents a hydrogen atom, or an alkyl group having from 1 to 18 carbon atoms, an alkenyl group having from 2 to 18 carbon atoms, an aralkyl group having from 7 to 18 carbon atoms, an alicyclic group having from 3 to 18 carbon atoms or an aryl group having from 6 to 18 carbon atoms which may be substituted, and specifically, it has the same meaning as defined for $Z_1$ described above.

$Q_0$ represents an aliphatic group having from 1 to 3 carbon atoms (for example, methyl, ethyl or propyl), preferably a methyl group.

In the general formula (II), $Z_1$ in the substituent represented by V has the same meaning as $Z_1$ in the general formula (I). When V represents $-C_6H_4-$, the benzene ring may have a substituent. Examples of the substituent include a halogen atom (for example, chlorine or bromine) or an alkyl group (for example, methyl, ethyl, propyl, butyl, chloromethyl or methoxymethyl).

$a_1$ and $a_2$ may be the same or different and have the same meanings as $a_1$ and $a_2$ in the general formula (I). k represents an integer of from 1 to 3.

A particularly preferred group for $a_1$ and $a_2$ in the general formula (I) and $b_1$ and $b_2$ in the general formula (II) is a hydrogen atom or a methyl group.

Preferred examples of the macromonomer (M) used in the present invention are represented by the following general formula (VIa) or (VIb):

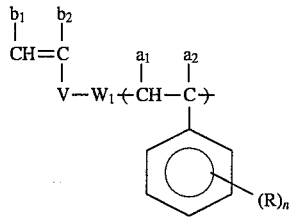

(VIa)

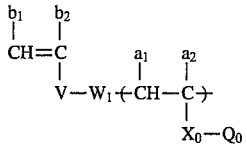

(VIb)

wherein $a_1$, $a_2$, $b_1$, $b_2$, $X_0$, $Q_0$ and V are as defined in the general formulae (I) and (II); $W_1$ represents a mere bond, or a single linking group selected from the atomic groups of $$-\overset{\overset{Z_6}{|}}{\underset{\underset{Z_7}{|}}{C}}-$$

(wherein $Z_6$ and $Z_7$ each represents a hydrogen atom, a halogen atom (for example, fluorine, chlorine or bromine), a cyano group or a hydroxyl group), —CH=CH—, a cyclohexylene group (including 1,2-, 1,3- and 1,4-cyclohexylene groups), a phenylene group (including 1,2-, 1,3- and 1,4-phenylene groups), —O—, —S—, $$-\overset{\overset{O}{||}}{C}-, \quad -\overset{\overset{Z_8}{|}}{N}-,$$

$$-COO-, \quad -SO_2-$$

$$-\overset{\overset{Z_8}{|}}{C}ON-, \quad -SO_2\overset{\overset{Z_8}{|}}{N}-,$$

—NHCOO—, —NHCONH— and $-Si(Z_8)(Z_9)-$ (wherein $Z_8$ and $Z_9$ each represents hydrogen atom or a hydrocarbon group which has the same meaning as the hydrocarbon group represented by $Z_1$) or a linking group composed of a combination of two or more of the above atomic groups.

Preferred examples of $X_0$, V, $a_1$, $a_2$, $b_1$ and $b_2$ in general formulas (I), (II), (VIa) and (Vib) are illustrated below.

Preferably, $X_0$ is a linking group selected from the group consisting of —COO—, —OCO—, —O—, $-CH_2COO-$ and $-CH_{20}CO-$ or a linking group composed of a combination of two or more of them; V is a linking group selected from the group consisting of the above-described linking groups (wherein $Z_1$ is hydrogen atom); and $a_1$, $a_2$, $b_1$ and $b_2$ are each hydrogen atom or methyl group.

The macromonomers (M) used in the present invention can be prepared by conventional synthesis methods. Examples of such synthesis methods include (1) an ion polymerization method wherein various reagents are reacted with the terminals of living polymers obtained by anion polymerization or cation polymerization to form macromers, (2) a radical polymerization method wherein various reagents are reacted with oligomers having a reactive terminal group obtained by radical polymerization in the presence of a polymerization initiator having a reactive group such as a carboxyl group, a hydroxyl group or an amino group in the molecule thereof and/or a chain transfer agent to form macromers, and (3) a polyaddition condensation method wherein a group having a polymerizable double bond is introduced into oligomers obtained by a polyaddition or polycondensation reaction in the same manner as in the above radical polymerization method.

More specifically, the macromonomers can be synthesized according to the methods described in P. Dreyfuss & R. P. Quirk, *Encycl. Polym. Sci. Eng.*, Vol. 7, page 551 (1987); P. F. Rempp & E. Franta, *Adv. Polym. Sci.*, Vol. 58, page 1 (1984); V. Percec, *Appl. Polym. Sci.*, Vol. 285, page 95 (1984); R. Asami, M. Takagi, *Makromol. Chem. Suppl.*, Vol. 12, page 163 (1985); P. Rempp. et al., *Makromol. Chem. Suppl.*, Vol. 8, page 3 (1987); Yushi Kawakami, *Kagaku Kogyo*, Vol. 38, page 56 (1987); Yuya Yamashita *Kobunshi*, Vol. 31, page 988 (1982); Shiro Kobayashi, *Kobunshi*, Vol. 30, page 625 (1981); Toshinobu Higashimura, *Nippon Setchaku Kyokaishi*, Vol. 18, page 536 (1982); Koichi Ito, *Kobunshi Kako*, Vol. 35, page 262 (1986); Kishiro Higashi and, Takashi Tsuda, *Kino Zairyo*, 1987, No. 10, page 5; and the literature and patent specifications cited therein.

For example, the macromonomer (M) can be produced by a radical polymerization in which an oligomer having a terminal carboxyl group obtained by a radical polymerization using a polymerization initiator containing a carboxyl group in its molecule and/or a chain transfer agent is reacted with an epoxy compound having a polymerizable double bond group using a quaternary ammonium salt as a reaction catalyst, thereby to form a macromonomer. Specifically, the macromonomer can be synthesized according to the method described in JP-A-62-232408. Preferred examples of the above-described epoxy compound having a polymerizable double bond groups include glycidyl methacrylate and glycidyl acrylate.

In producing the macromonomer, a tertiary amine or a quaternary ammonium salt is used as a reaction catalyst. In order to prevent the macromonomer from being colored, it is preferred to use the quaternary ammonium salt. By using the quaternary ammonium salt as the reaction catalyst, not only the macromonomer can be prevented from being colored, but also unexpectedly it becomes possible to impart a positive charge to the toner particles.

The quaternary ammonium salt used in the present invention can be represented by $R_1R_2R_3R_4N^+X^-$. $R_1$, $R_2$, $R_3$ and $R_4$ each represents an alkyl group having from 1 to 32 carbon atoms which may be substituted (for example, methyl, ethyl, butyl, hexyl, octyl, decyl, dodecyl, hexadecyl, octadecyl, docosanyl, 2-ethylhexyl, 4-butoxybutyl and N,N-dibutylaminopropyl); an alkenyl group having from 3 to 32 carbon atoms which may be substituted (for example, allyl, 2-pentenyl, 4-propyl-2-pentenyl, decenyl, oleyl and linoleyl); an aralkyl group having from 7 to 36 carbon groups which may be substituted (for example, benzyl and phenethyl); an alicyclic hydrocarbon group having from 5 to 32 carbons which may be substituted (for example, cyclopentyl, cyclohexyl, bicyclo[2,2,1]-heptyl and cyclohexenyl); an aryl group having from 6 to 38 carbon atoms which may be substituted (for example, phenyl, tolyl, 4-butylphenyl, 4-decylphenyl and 4-butoxyphenyl); or a heterocyclic group having at least 5 carbon atoms (for example, furyl and thienyl). The substituent groups include fluorine, chlorine, bromine, iodine, hydroxyl, nitro, nitrile, amino, alkoxy, sulfo and carboxyl.

$R_1$, $R_2$, $R_3$ and $R_4$ may be the same or different. Two of $R_1$, $R_2$, $R_3$ and $R_4$ may be linked together, and may have intervening 1 to 4 hetero atoms. They may further contain 0 to 6 double bonds and may form a mononuclear or polynuclear cyclic compound containing from 4 to 12 carbon atoms which is substituted by a halogen atom, an alkyl group having from 1 to 6 carbon atoms, an alkoxy group having from 1 to 6 carbon atoms, a hydroxyl group, a nitro group or-an amino group.

$X^-$ represents an organic or inorganic anion. $R_1$ to $R_4$ may be substituted by $—COO^-$ or $—SO_3^-$. In this case, $X^-$ need not be present.

$X^-$ includes anions of halogen atoms (for example, $Cl^-$, $Br^-$ and $I^-$), $PF_6^-$, sulfates, phosphates, cyanates, thiocyanates, $BF_4^-$, $B(aryl)_4^-$ (for example, tetraphenyl borate, p-chlorotetraphenyl borate and p-methyltetraphenyl borate), phenolates, nitrophenolates, saturated or unsaturated carboxylates or aromatic carboxylates (for example, acetates, lactates, benzoates and salicylates), sulfonates (for example, ethysulfonate, phenylsulfonate and p-toluenesulfonate).

Specific examples of the quaternary ammonium salts include tetramethylammonium chloride, tetramethylammonium p-toluenesulfonate, tetramethylammonium tetraphenylborate, tetraethylammonium bromide, tetraethylammonium salicylate, tetra-n-propylammonium bromide, tetrabutylammonium chloride, tetrabutylammonium phenylsulfonate, tetraoctylammonium iodide, cetyltrimethylammonium chloride, cetyldimethylammonium bromide, benzyltrimethylammonium chloride, butylpyridinium bromide, laurylpyridinium bromide, cetylpyridinium chloride, 1-hexadecylpyridinium chloride and 2-dodecylisoquinolium bromide, but the present invention is not limited to these examples.

Any solvents may be used as a reaction solvent as long as they can dissolve the macromonomer. Examples of such solvents include toluene, xylene, benzene, methyl ethyl ketone, methyl isobutyl ketone, butyl acetate and N-dimethylformamide. In particular, toluene and butyl acetate are preferably used. In addition, in order to prevent polymerization during the production of the macromonomer, it is preferred that a radical polymerization inhibitor such as hydroquinones and hydroquinone monomethyl ethers is added at a stage of the macromonomer forming reaction.

The polymerization inhibitor is added preferably in an amount of 10 to 1000 ppm based on the total amount of the reaction solution.

The polymerizable double bond-containing epoxy compound such as glycidyl methacrylate is preferably added in an amount of from 0.9 to 3.0 times molar equivalent to that of carboxyl groups contained in the reaction solution. Further, the quaternary ammonium salt as a reaction catalyst such as tetrabutyl ammonium bromide is preferably added in an amount of from 0.1 to 5.0% by weight based on the total amount of the reaction solution.

Generally, the reaction temperature is preferably from 50° to 200° C., and more preferably from 70° to 150° C.

The monomers represented by general formula (III) which are components of the graft copolymers in combination with the above-described macromonomers (M) are described below.

In general formula (III), $X_1$ has the same meaning as defined for the linking group represented by $X_0$ in general formula (I), and preferred examples thereof include —COO—, —OCO—, —$CH_{20}$CO—, —$CH_2$COO—, and —O—. $Q_1$ represents an aliphatic group having from 4 to 22 carbon atoms. Specifically, it has the same meaning as defined for the aliphatic group represented by $Z_1$ in general formula (I).

$c_1$ and $c_2$ may be the same or different, and specifically, they have the same meanings as defined for $a_1$ and $a_2$ in general formula (I). It is preferred that either of $c_1$ and $c_2$ is a hydrogen atom.

The graft copolymer may contain other monomers which are copolymerizable with the monomer represented by general formula (III) in addition to this monomer. Examples of such other monomers include acrylonitrile, methacrylonitrile, acrylamide, methacrylamide, hydroxyethyl methacrylate, dialkylaminoethyl methacrylates (for example, dimethylaminoethyl methacrylate), styrene, chlorostyrene, bromostyrene, vinylnaphthalene, polymerizable double bond group-containing heterocyclic compounds (for example, vinylpyridine, vinylimidazoline, vinylthiophene, vinyldioxane and vinylpyrrolidone), unsaturated carboxylic acids (for example, acrylic acid, methacrylic acid, itaconic acid, crotonic acid and maleic acid), iraconic anhydride and maleic anhydride.

The monomer other than the monomer represented by general formula (III) may be any monomer as long as it is polymerizable, and is preferably contained in an amount of not more than 30% by weight based on the whole components of the graft copolymer.

In the graft copolymer used in the present invention, at least one polar group selected from the group consisting of the following specific polar groups may be bonded to only one terminal of the main chain of the polymer.

Such polar groups include —$PO_3H_2$, —$SO_2$H, —COOH, —OH, —SH, —($Z_0$)P(O)OH (wherein $Z_0$ represents —$Z_{10}$ or —O$Z_{10}$, wherein $Z_{10}$ represents a hydrocarbon group), formyl and amino.

In —($Z_0$)P(O)OH of the polar group, $Z_0$ represents —$Z_{10}$ or —O$Z_{10}$, wherein $Z_{10}$ preferably represents a hydrocarbon group having from 1 to 18 carbon atoms. More preferred examples of the hydrocarbon groups represented by $Z_{10}$ include an aliphatic group having from 1 to 8 carbon atoms which may be substituted (for example, methyl, ethyl, propyl, butyl, pentyl, hexyl, butenyl, pentenyl, hexenyl, 2-chloroethyl, 2-cyanoethyl, cyclopentyl, cyclohexyl, benzyl, phenethyl, chlorobenzyl and bromobenzyl); and an aromatic group which may be substituted (for example, phenyl, tolyl, xylyl, mesityl, chlorophenyl, bromophenyl, methoxyphenyl and cyanophenyl).

In the polar groups used in the present invention, the amino group represents —$NH_2$, —$NHZ_{11}$ or —$NZ_{11}$($Z_{12}$). Each of $Z_{11}$ and $Z_{12}$ independently represents a hydrocarbon group having from 1 to 18 carbon groups, and preferably a hydrocarbon group having from 1 to 8 carbon atoms. Specifically, it has the same meaning as defined for the hydrocarbon group represented by $Z_1$ described above.

More preferably, the hydrocarbon group represented by $Z_{10}$, $Z_{11}$ and $Z_{12}$ includes an alkyl group having from 1 to 4 carbon atoms which may be substituted, a benzyl group which may be substituted and a phenyl group which may be substituted.

The polar group has a chemical structure in which the polar group is bonded directly to one of the terminals of the main chain of the polymer or bonded through a linkage group. The bond which connects the graft copolymer component to the polar group include a carbon-carbon bond (single or double bond), a carbon-hetero atom bond (examples of the hetero atoms include an oxygen atom, a sulfur atom, a nitrogen atom and a silicon atom), a hetero atom-hetero atom bond and a combination thereof.

The graft copolymer in which the specific polar group is bonded to only one terminal of the main chain of the polymer can be easily produced by the methods described in the reviews such as Y. Chujyo and Y. Yamashita, *Senryou to Yakuhin* (*Dyes and Drugs*), 30, 232 (1985) and A. Ueda and S. Nagai, *Kagaku to Kougyou* (*Chemistry and Industry*), 60, 57 (1986) and in the literature references cited therein.

The dispersion stabilizing resin used in the present invention can be prepared by polymerization in a solution of monomers containing at least one of each of (a) methyl methacrylate or ethyl methacrylate, and (b) an acrylic acid ester or a methacrylic acid ester each having an alkyl group containing not more than 4 carbon atoms in the presence of a dispersion stabilizing resin. As long as the resin grains synthesized from the monomers are insoluble in the above-described non-aqueous solvent, they can be used as the desired dispersed resin grains.

Preferred examples of the monomers used for the dispersed resin grains include combinations of methyl methacrylate and methyl acrylate, methyl methacrylate and ethyl acrylate, methyl methacrylate and propyl acrylate, methyl methacrylate and butyl acrylate, methyl methacrylate and butyl methacrylate, or ethyl methacrylate and methyl acrylate.

In addition to the above-described preferred monomers, the dispersed resin grains may contain other monomers (c) which are copolymerizable with these monomers.

Examples of the monomer (c) include vinyl monomers having a basic nitrogen atom or an amido group.

Specific examples of the monomer (c) include vinyl monomers such as aminoalkyl-substituted (meth)acrylates represented by the following general formula (IV), quaternary salts of aminoalkyl-substituted (meth)acrylates represented by the following general formula (V), N-vinylimidazole, N-vinyl-2-methylimidazole, 1-vinylpyrrole, N-β-acryloxyethylindole, 2-vinylquinoline, 4-vinylpyridine, 5-vinyl-4-methylthiazole, 3-methyl-5-isopropenylpyrazole, N-vinyl-2-pyrrolidone, N-vinylpiperidone, N-vinyloxazolidone, dimethylaminostyrene, dialkylaminomethylstyrenes, quaternary salts of dialkylaminostyrenes and (meth)acrylamide.

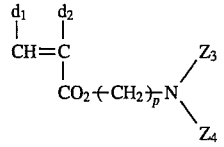

(IV)

In general formula (IV), $d_1$ and $d_2$ may be the same or different and each represents hydrogen atom or methyl group; $Z_3$ and $Z_4$ may be the same or different and each has the same meaning as $Z_1$, and p represents an integer of 1 to 3.

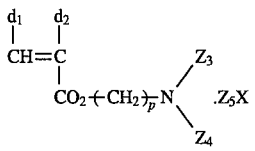

(V)

In general formula (V), $d_1$, $d_2$, p, $Z_3$ and $Z_4$ are the same as those set forth in general formula (IV); $Z_5$ represents an alkyl group having 1 to 18 carbon atoms or an aralkyl group having 7 to 24 carbon atoms; and X represents a halogen atom (fluorine, chlorine, bromine or iodine), an acetate, $BF_4$, a sulfate, p-toluenesulfonate or an alkylsulfonate.

The acrylic esters or methacrylic esters having an alkyl group having not more than 4 carbon atoms are present in the resin particles in an amount of 0.1 to 9 mol per mol of methyl methacrylate and/or ethyl methacrylate.

The content of the monomer component (c) copolymerizable with the above-described monomers (a) and (b) is not more than 30 mol % based on the total amount of the monomers.

The dispersed resin particles used in the present invention have a molecular weight of from $1\times10^3$ to $1\times10^6$.

The dispersed resin particles (latex particles) used in the present invention can be prepared by polymerizing the (meth)acrylic ester monomers in the presence of the above-described dispersion stabilizing resin and a polymerization initiator such as benzoyl peroxide, azobis(2,4-dimethylvaleronitrile), azobis(4-methoxy-2,4-dimethylvaleronitrile), azobisisobutyronitrile or butyllithium in a non-aqueous solvent with heating.

More specifically, the dispersed resin particles can be prepared by any of (1) a method wherein a polymerization initiator is added to a mixed solution containing the dispersion stabilizing resin, the monomer (a), the monomer (b) and optionally the monomer (c); (2) a method wherein the monomer (a), the monomer (b) and optionally the monomer (c) together with the polymerization initiator are added dropwise to a solution containing the dispersion stabilizing resin dissolved therein; (3) a method wherein the whole of the dispersion stabilizing resin and a part of a mixture of the monomer (a), the monomer (b) and optionally the monomer (c) are dissolved in a solvent, and the remainder of the monomer mixture together with the polymerization initiator is added to the above mixed solution; and (4) a method wherein a mixed solution containing the dispersion stabilizing resin and the monomer mixture together with the polymerization initiator is added to the non-aqueous solution.

The total amount of the (meth)acrylic esters is about 5 to about 80 parts by weight, preferably 10 to 50 parts by weight based on 100 parts by weight of the non-aqueous solvent.

The resin dissolved or dispersed in a colloidal form as a dispersion stabilizer is used in an amount of 1 to 100 parts by weight, preferably 3 to 50 parts by weight based on 100 parts by weight of the whole monomers.

The amount of the polymerization initiator is preferably 0.1 to 5 mol % based on the amount of the whole monomers. The polymerization temperature is about 20° to about 180° C., preferably 30° to 120° C. The reaction time is preferably 1 to 15 hours.

It is preferred that when the above-described polar solvents such as the above-described alcohols, ketones, ethers or esters together with the non-aqueous solvent are used for the reaction or when the unreacted materials of the monomer (a), the monomer (b) and optionally the monomer (c) to be polymerization-granulated are left behind, the reaction mixture is heated at a temperature of not lower than the boiling point of the solvents or the monomers to distil them off, or the solvents or the monomers are distilled off under reduced pressure.

The latex grains dispersed in the non-aqueous solvent these prepared are very fine particles having a uniform particle size distribution and exhibit very stable dispersibility. Particularly, even when the liquid developer is repeatedly used in a developing apparatus over a long period of time, the particles retain good dispersibility, and even when development speed is increased, the particles can be readily redispersed and any staining caused by the adhesion thereof to the various parts of the apparatus is not observed at all.

Further, when the latex grains are fixed by heating, a strong coating film or layer is formed and the particles exhibit excellent fixing properties.

Furthermore, the liquid developer of the present invention enables the development-fixing stage to be expedited. Even when the intervals of maintenance are prolonged, the liquid developer of the present invention is excellent in dispersion stability, redispersibility and fixability.

If desired, the liquid developer of the present invention may contain coloring agents. Any of conventional pigments or dyes can be used as the coloring agents in the present invention without particular limitation.

When the dispersed resin itself is to be colored, an example of the coloring method includes a method wherein a pigment or a dye is physically dispersed in the dispersed resin. Many pigments and dyes which can be used are known. Examples thereof include magnetic iron oxide powder, lead iodide powder, carbon black, nigrosine, Alkali Blue, Hansa Yellow, Quinacridone Red and Phthalocyanine Blue.

Another coloring method is a method wherein the dispersed resin is dyed with a preferred dye as described in JP-A-57-48738. Still another coloring method is a method wherein the dispersed resin is chemically bonded to a dye as described in JP-A-53-54029. Other method is such that when the dispersed resin is prepared by the polymerization granulation method, monomers containing previously a dye are used to prepare a dye-containing copolymer as described in JP-B-44-22955.

If desired, various charge controlling agents may be added to the liquid developer of the present invention to enhance charging characteristics or to improve image characteristics.

Any of conventional charge controlling agents for liquid developers can be used in the present invention. Examples of the charge controlling agents include metal salts of fatty acids such as naphthenic acid, octenic acid, oleic acid and stearic acid and metal salts of sulfosuccinates; metal salts of oil-soluble sulfonic acids described in JP-β-45-556, JP-A-52-37435 and JP-A-52-37049; metal salts of phosphoric acid esters described in JP-β-45-9594; abietic acids and metals of hydrogenated abietic acids described in JP-B-48-25666; calcium salts of alkylbenzenesulfonic acids described in JP-β-55-2620; metal salts of aromatic carboxylic acids or sulfonic aids, nonionic surfactants such as polyoxyethylated alkylamines, fats and oils such as lecithin and linseed oil, polyvinyl pyrrolidone, esters of organic acids with polyhydric alcohols described in JP-A-52-107837, JP-A-52-38937, JP-A-57-90643 and JP-A-57-139753; phosphoric ester surfactants described in JP-A-57-210345; and sulfonic acid resins described in JP-β-56-24944. Other examples of the charge controlling agents which can be used include amino acid derivatives described in JP-A-60-21056 and JP-A-61-50951; copolymers containing a maleic acid half amide component described in JP-A-60-173558 and JP-A-60-179750; and quaternized amine polymers described in JP-A-54-31739 and JP-β-56-24944.

Among them, preferred are metal salts of naphthenic acid, metal salts of dioctyl sulfosuccinate, the copolymers containing a maleic acid half amide component, lecithin and the above-described amino acid derivatives.

These charge controlling agents may be used in combination of two or more of the above compounds. The charge controlling agents are used in an amount of preferably 0.001 to 1.0 part by weight based on 1,000 parts by weight of the carrier solution.

If desired, various additives may be added. The upper limit of the total amount of the additives is set by the electric resistance of the developer. Namely, when the liquid developer from which the toner particles are removed has an electric resistance of less than $10^9$ Ωcm, it is difficult to obtain a continuous tone image of good quality, and hence the amounts of the additives should be controlled so as to conform to this limit.

Various supports can be used as an electrically conductive substrate material for the electrophotographic printing plate precursor of the present invention. For example, a synthetic resin sheet with an electrically conductive surface, a solvent-impermeable and electrically conductive paper, and an electrically conductive substrate material with a hydrophilic surface such as an aluminum plate, a zinc plate, a bimetal plate (e.g., a copper-aluminum plate, a copper-stainless steel plate, a chromium-copper plate) or a trimetal plate (e.g., a chromium-copper-aluminum plate, a chromium-lead-iron plate, a chromium-copper-stainless steel plate) can be used. The thickness of such a substrate is preferably in the range of 0.1 to 3 mm, particularly 0.1 to 0.5 mm. Particularly preferred of these substrate materials is an aluminum plate.

Suitable aluminum plates for the present invention include a plate of pure aluminum comprising aluminum as the main component or a plate of an aluminum alloy containing a small amount of different element. The composition of such an aluminum plate is not specifically limited. Materials which are heretofore known and commonly used can be appropriately employed in the present invention.

The aluminum plate can be grained and anodically oxidized in any known manner before use. Before graining, the aluminum plate may be optionally degreased with a surface active agent or an alkaline aqueous solution to remove rolling oil therefrom. The graining can be accomplished by mechanically toughening the surface of the material, electrochemically dissolving the surface of the material or chemically and selectively dissolving the surface of the material. Mechanical roughening can be accomplished using any known methods such as a ball grinding method, a brush grinding method, a blast grinding method or a buff grinding method. Electrochemical roughening can be effected in a hydrochloric acid or nitric acid electrolyte with an alternating current or direct current being supplied. The two processes can be used in combination as disclosed in JP-A-54-63902.

The aluminum plate thus roughened is optionally subjected to etching with an alkali and a neutralization treatment.

The aluminum plate thus treated is then anodically oxidized. Sulfuric acid, phosphoric acid, oxalic acid, chromic acid or a mixture thereof can be used as an electrolyte in the anodic oxidation. The content and concentration of the electrolyte depend on the type of the electrolyte used. The conditions under which the anodic oxidation is effected depend on the type of the electrolyte and are not specifically limited. In general, the anodic oxidation is preferably effected with an electrolyte concentration of 1 to 80% by weight at a temperature of 5° to 70° C., a current density of 5 to 60 A/dm$^2$ and a voltage of 1 to 100 V for 10 seconds to 50 minutes. The amount of film obtained by the anodic oxidation is preferably in the range of 0.1 to 10 g/m$^2$, particularly 1 to 6 g/m$^2$.

As described in JP-β-47-5125, an aluminum support obtained by anodic oxidation of an aluminum plate and then immersing the material in an aqueous solution of a silicate of an alkaline metal can be advantageously used. As described in U.S. Pat. No. 3,658,662, an aluminum support obtained by electro-depositing a silicate on an aluminum plate can also be effectively used. A treatment with a polyvinylsulfonic acid as described in West German Patent Disclosure No. 1,621,478 can also be advantageously used.

Any of many compounds conventionally known can be used as organic photoconductive compounds in the present invention. Examples of such compounds which can be used as the organic photoconductive compounds in the present invention include triazole derivatives, oxadiazole derivatives, imidazole derivatives, polyarylalkane derivatives, pyrazoline derivatives, pyrazolone derivatives, phenylenediamine derivatives, arylamine derivatives, amino-substituted chalcone derivatives, N,N-bicarbazyl derivatives, oxazole derivatives, styrylanthracene derivatives, fluorenone derivatives, hydrazine derivatives, benzidine derivatives and stilbene derivatives.

In addition to the above-described low-molecular photoconductive compounds, high-molecular compounds can be used. Examples of the high-molecular compounds include vinyl polymers such as polyvinyl carbazole and derivatives thereof, vinyl polymers such as polyvinylpyrene, polyvinylanthracene, poly-2-vinyl-4-(4 '-di-methylaminophenyl)-5-phenyloxazole and poly-3-vinyl-N-ethylcarbazole; polymers such as polyacenaphthylene, polyindene and copolymers of acenaphthylene with styrene; and condensed resins such as pyrene-formaldehyde resins, bromopyrene-formaldehyde resins and ethylcarbazole-formaldehyde resins.

Further, various pigments can be used as the organic photoconductive compounds. Examples of the pigments include monoazo, bisazo and tris-azo pigments, phthalocyanine pigments such as metal phthalocyanine pigments and metal-free phthalocyanine pigments, perylene pigments, indigo, thioindigo derivatives, quinacridone pigments, polycyclic quinone pigments, bisbenzimidazole pigments, squarylium salt pigments and azulenium salt pigments.

These organic photoconductive compounds may be used either alone or in a combination of two or more of them.

The photoconductive layer of the present invention may contain sensitizing agents such as sensitizing dyes for the purpose of improving sensitivity, and the like. Examples of the sensitizing dyes which can be used in the present invention include conventional compounds described in *Sensitizing Agent,* page 125 (published by Kodansha 1987), *Electrophotography,* Vol. 12, page 9 (1973) and *Organic Synthesis Chemistry,* Vol. 24, No. 11, page 1010 (1966). Specific examples of the sensitizing dyes include pyrylium dyes, triarylmethane dyes, cyanine dyes and styryl dyes.

Other examples of the sensitizing agents which can be used in addition to the sensitizing dyes include electron attractive compounds such as trinitrofluorenone, chloranil and tetracyanoethylene.

Any of binder resins can be used in the original plate for printing for use in the making of a plate for electrophotography without particular limitation, so long as the non-image areas can be removed by the etching solutions after toner development. Examples of the binder resins include copolymers of a (meth)acrylate, styrene or vinyl acetate with a monomer having carboxyl group or acid anhydride group such as (meth)acrylic acid, iraconic acid, crotonic acid, maleic acid, maleic anhydride, a monoalkyl maleate and fumaric acid (for example, styrene/maleic anhydride copolymers, styrene/monoalkyl maleate copolymers, (meth)acrylic acid/(meth)acrylate copolymers, styrene/(meth)acrylic acid/

(meth)acrylate copolymers, vinyl acetate/crotonic acid copolymers, vinyl acetate/crotonic acid/(meth)acrylate copolymers, and vinyl acetate/vinyl ester of $C_2$ to $C_{18}$ carboxylic acid/crotonic acid copolymers); copolymers of (meth)acrylamide or vinyl-pyrrolidone with a monomer having phenolic hydroxyl group, sulfo group, sulfonamido group or sulfonimido group; novolak resins obtained by condensating phenol, o-cresol, m-cresol or p-cresol with formaldehyde or acetaldehyde; partially saponified vinyl acetate resins; polyvinyl acetal resins such as polyvinyl butyral; and urethane resins having a carboxyl group.

Among these binder resins, the copolymers of a (meth-)acrylate, styrene or vinyl acetate with a monomer having a carboxyl group such as (meth)acrylic acid, the copolymers of a (meth)acrylate, styrene or vinyl acetate, and a monomer having carboxyl group such as (meth)acrylic acid with another monomer are preferred from the viewpoints of electrophotography, etching and printability.

More preferred are the copolymers of (meth)acrylic acid with an ester derived from (meth)acrylic acid and an aliphatic or aromatic alcohol such as methyl alcohol, ethyl alcohol, propyl alcohol, isopropyl alcohol, butyl alcohol, isobutyl alcohol, sec-butyl alcohol, tert-butyl alcohol, n-amyl alcohol, isoamyl alcohol, hexyl alcohol, octyl alcohol, benzyl alcohol or phenethyl alcohol.

The electrophotographic printing plate precursor according to the present invention can be prepared by coating a photoconductive layer on the photoconductive aluminum substrate in a conventional manner. Examples of conventional methods for preparing the photoconductive layer include a method wherein components which constitute the photoconductive layer are contained in the same layer and a method wherein a charge carrier generating material and a charge carrier transporting material are separately contained in different layers. Any of these methods can be used in the present invention to prepare the photoconductive layer. A coating solution for forming the photoconductive layer can be prepared by dissolving components constituting the layer in an appropriate solvent. When solvent-insoluble ingredients such as a pigment, etc. are used, the ingredients are finely divided into a powder having a particle size of not larger than 5 μm and dispersed by using a dispersion device such as a ball mill, a paint shaker, a dyno mill or an attritor. The binder resin and other additives which are used in the photoconductive layer can be added to the coating solution during or after the dispersion of the pigment, etc. The thus-prepared coating solution is coated on the substrate by a conventional method such as rotary coating, blade coating, knife coating, reverse roll coating, dip coating, rod bar coating or spray coating, and the coated substrate is dried to obtain the printing plate precursor for use in the making of a plate for electrophotography.

Examples of the solvent which can be used to prepare the coating solution include halogenated hydrocarbons such as dichloromethane, dichloroethane and chloroform; alcohols such as methanol and ethanol; ketones such as acetone, methyl ethyl ketone and cyclohexanone; glycol ethers such as ethylene glycol monomethyl ether and 2-methoxyethyl acetate; ethers such as tetrahydrofuran and dioxane; and esters such as ethyl acetate and butyl acetate.

Various additives such as plasticizers, surfactants, matting agents, etc. in addition to the photoconductive compound and the binder resin may be optionally added to the photoconductive layer of the present invention to improve the flexibility and coated surface profile of the photoconductive layer. These additives may be used in such an amount that the electrostatic characteristics and etchability of the photoconductive layer are not deteriorated by them.

With regard to the thickness of the photoconductive layer, the layer can not be charged at a surface potential required for development when the thickness is too thin, while when the thickness is too thick, side etching is liable to be caused and a good printing plate can not be obtained. The thickness of the photoconductive layer is generally about 0.1 to about 30 μm, preferably 0.5 to 10 μm.

With regard to the contents of the binder resin and the photoconductive compound in the photoconductive layer of the present invention, sensitivity is lowered when the content of the photoconductive compound is low. Accordingly, the photoconductive compound is used in an amount of preferably 0.05 to 1.2 parts by weight, more preferably 0.1 to 1.0 part by weight per one part by weight of the binder resin.

Any of solvents can be used as the etching solutions for removing the photoconductive insulating layer of the non-image areas after the formation of the toner image, so long as the photoconductive insulating layer can be removed. Though there is no particular limitation with regard to the solvents to be used, alkaline solvents can be preferably used. The term "alkaline solvent" as used herein refers to an aqueous solution containing an alkaline compound, an organic solvent containing an alkaline compound or a mixture of an aqueous solution containing an alkaline compound and an organic solvent containing an alkaline compound.

Examples of the alkaline compound include organic and inorganic alkaline compounds such as sodium hydroxide, potassium hydroxide, sodium carbonate, sodium. silicate, potassium silicate, lithium silicate, sodium metasilicate, potassium metasilicate, sodium phosphate, potassium phosphate, ammonia, monoethanolamine, diethanolamine, triethanolamine, monoisopropanolamine, triisopropanolamine, diethylaminoethanol and 2-amino-2-methylpropanol.

Of these compounds, when a silicate represented by the general formula of m $SiO_2$/n $M_2O$ (wherein M: an alkali metal, m/n (molar ratio)=0.5 to 8.5) is incorporated into the etching solution, better etching property and printing characteristics can be obtained.

If desired, various organic solvents can be optionally added to the etching solution mainly composed of water. Preferred examples of the organic solvents include lower alcohols and aromatic alcohols such as methanol, ethanol, propanol, butanol, benzyl alcohol and phenethyl alcohol; polyhydric alcohols such as ethylene glycol, diethylene glycol, triethylene glycol and polyethylene glycol; ether alcohols; ether esters; ethers; ketones; and esters. Further, surfactants, anti-foaming agents and other additives may be optionally incorporated into the etching solutions.

Production examples of the dispersion stabilizing resins, production examples of the latex particles and examples of the present invention are hereinafter described, but it should be understood that the scope of the present invention is not limited thereto.

In the following examples, the term "latex grains" is used in place of the term "copolymer resin grains" which is often used in the specification in order to distinguish them from the dispersion stabilizing resins.

PRODUCTION EXAMPLE 1 OF MACROMONOMER (M-1)

A mixed solution of 100 g of methyl methacrylate, 4.5 g of thioglycolic acid and 100 g of toluene was heated to a temperature of 70° C. with stirring under nitrogen stream. Then, 2.0 g of azobisisobutyronitrile (hereinafter abbreviated as A.I.B.N.) was added thereto, followed by reacting for 4 hours. The resulting reaction solution was cooled to room temperature, and 9.0 g of glycidyl methacrylate, 0.1 g of hydroquinone and 3.6 g of tetrabutylammonium bromide were added thereto, followed by reacting at 90° C. for 5 hours.

After cooling, the reaction solution was reprecipitated in 2 liters of methanol, and the precipitated white solid was collected by decantation and dissolved in 300 ml of tetrahydrofuran. The solution was reprecipitated again in 3 liters of methanol. The precipitated white powder was collected and dried under reduced pressure to obtain 94.0 g of a polymer having a weight average molecular weight of 15,500. The molecular weight is a polystyrene converted value by the GPC method.

Macromonomer M-1

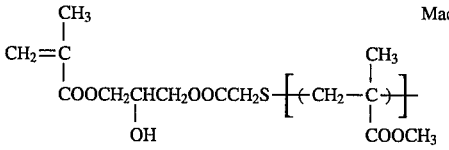

PRODUCTION EXAMPLE 2 OF MACROMONOMER (M-2)

A mixed solution of 100 g of methyl methacrylate, 4.5 g of thioglycolic acid and 200 g of toluene was heated to 75° C. with stirring in a nitrogen gas stream. Then, 1.0 g of azobisisobutyronitrile (hereinafter abbreviated as A.I.B.N.) was added thereto, and the mixture was reacted for 2 hours. Further, 1.0 g of A.I.B.N. was added thereto, and the reaction was carried out for 4 hours. The resulting reaction solution was cooled to room temperature, and 8.3 g of 2-hydroxyethyl methacrylate was added thereto. A mixed solution of 13.3 g of dicyclohexylcarbodiimide (abbreviated as D.C.C.) and 20 g of methylene chloride was added dropwise thereto over a period of one hour. Then, 0.1 g of 4-dimethylaminopyridine and 0.1 g of t-butylhydroquinone were added thereto, and the mixture as such was stirred for 4 hours.

The precipitated crystal was recovered by filtration. The filtrate was reprecipitated in 2 l of methanol. The precipitated white solid was collected by decantation, dissolved in 300 ml of tetrahydrofuran and reprecipitated in 3 l of methanol. The precipitated white powder was collected and dried under reduced pressure to obtain 93.2 g of a polymer having a weight average molecular weight of 15,000.

Macromonomer (M-2)

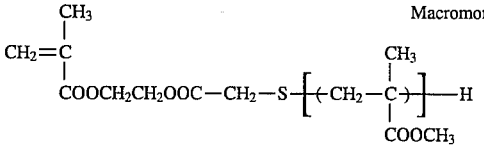

PRODUCTION EXAMPLES 3 TO 10 OF MACROMONOMERS (M-3 TO M-10)

Each of the macromonomers shown in Table A below was prepared in the same manner as described in Production Example 1 or 2 of Macromonomer by changing a methacrylate monomer (corresponding to methyl methacrylate), a chain transfer agent (corresponding to thioglycolic acid), a polymerization initiator (corresponding to A.I.B.N.) and a compound having a polymerizable double bond group (corresponding to glycidyl methacrylate or 2-hydroxyethyl methacrylate) in Production Example 1 or 2 of Macromonomer. The weight average molecular weight of the resulting macromonomers was in the range of from 1,000 to 60,000.

TABLE A

| Production Example of Macromonomer | Macro-monomer | Chemical Structure of Macromonomer |
|---|---|---|
| 3 | M-3 | 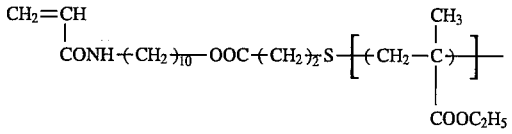 |
| 4 | M-4 | 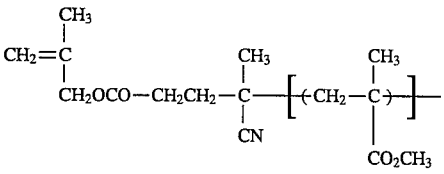 |
| 5 | M-5 | 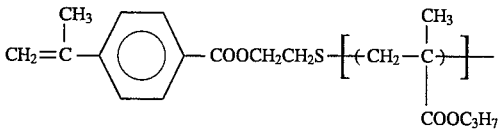 |
| 6 | M-6 | 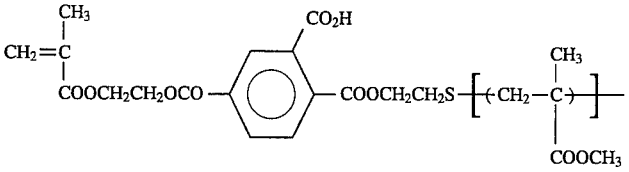 |

TABLE A-continued

| Production Example of Macromonomer | Macro-monomer | Chemical Structure of Macromonomer |
|---|---|---|
| 7 | M-7 | 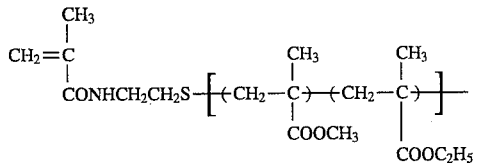 |
| 8 | M-8 | 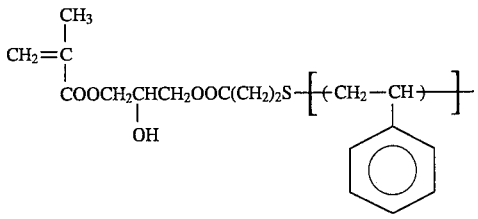 |
| 9 | M-9 | 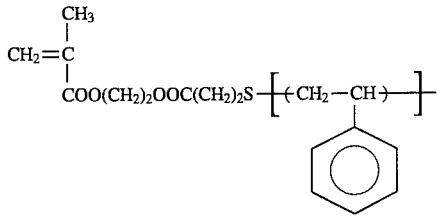 |
| 10 | M-10 | 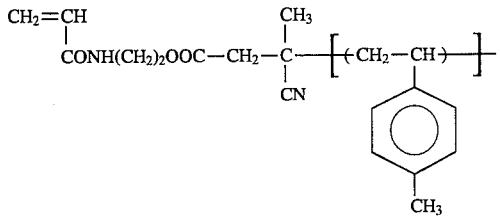 |

Dispersion Stabilizing Resin Preparation Example 1 (P-1)

A graft copolymer was synthesized using a styrene type macromonomer AS-6 (produced by Toagosei Chemical Industry Co., Ltd.; terminal group: methacryloyl group; a number average molecular weight: 6,000).

A mixed solution of 50 g of AS-6, 50 g of 2-ethylhexyl methacrylate and 200 g of toluene was placed in a four-necked flask and heated to a temperature of 80° C. with stirring in a nitrogen gas stream.

Subsequently, 1 g of 1,1'-azobis(1-cyclohexanecarbonitrile) as a polymerization initiator was added thereto, and a polymerization reaction was carried out at 80° C. for 24 hours. After the polymerization reaction, the reaction mixture was cooled to room temperature, and 200 g of toluene was further added thereto. The mixture was reprecipitated in 4 l of methanol. After filtration, the resulting white powder was dried to obtain 92 g of a graft copolymer of (2-ethylhexyl methacrylate) polymer/(styrene)polymer having a weight average molecular weight of $8.9\times10^4$ as a powder.

Dispersion Stabilizing Resin Preparation Examples 2 to 10 (P-2 to P-10)

Each of dispersion stabilizing resins P-2 to P-10 was prepared in the same manner as in Preparation Example 1 of P-1 except that each of monomers and each of macromonomers shown in Table B were used in place of AS-6 and 2-ethylhexyl methacrylate used in Preparation Example 1. The resulting resins had a weight average molecular weight of $1.1\times10^4$ to $1.4\times10^4$.

The macromonomers AA-6 and AA-2 are methyl methacrylate type macromonomers having a methacryloyl terminal group and having a number average molecular weight of 6,000 and 2,000, respectively, produced by Toagosei Chemical Industry Co., Ltd.

TABLE B

| Preparation Example of Resin | Dispersion Stabilizing Resin | Monomer | Macromonomer (corresponding to AS-6) | Macromonomer/ Monomer (wt/wt) |
|---|---|---|---|---|
| 2 | P-2 | Stearyl methacrylate | AS-6 | 20/80 |
| 3 | P-3 | Lauryl methacrylate | AS-6 | 50/50 |
| 4 | P-4 | 2-Ethylhexyl methacrylate | AS-6 | 30/70 |
| 5 | P-5 | Stearyl methacrylate | AA-6 | 10/90 |
| 6 | P-6 | Lauryl methacrylate | AA-6 | 10/90 |
| 7 | P-7 | 2-Ethylhexyl methacrylate | AA-6 | 10/90 |
| 8 | P-8 | Butyl acrylate | AA-6 | 10/90 |
| 9 | P-9 | 2-Ethylhexyl methacrylate | AA-2 | 10/90 |
| 10 | P-10 | 2-Ethylhexyl methacrylate | AA-2 | 20/80 |

Preparation Example 1 of Comparative Dispersion Stabilizing Resin: (R-1)

In the same manner as in Preparation Example 1 of Dispersion Stabilizing Resin, 50 g of styrene, 50 g of 2-ethylhexyl methacrylate and 200 g of toluene were placed in a four-necked flask, and the flask was purged with nitrogen gas. After the mixture was heated at 80° C. for one hour, 1 g of 1,1'-azobis(1-cyclohexanecarbonitrile) was added thereto, and a polymerization reaction was carried out at 80° C. for 24 hours. In the same manner as in Preparation Example 1, reprecipitation was conducted in methanol to obtain a polymer. The resulting polymer was a random copolymer and had a weight average molecular weight of $8.3\times10^4$.

Preparation Example 2 of Comparative Dispersion Stabilizing Resin: (R-2)

A random copolymer was prepared in the same manner as in Comparative Preparation Example 1 except that 10 g of methyl methacrylate and 90 g of stearyl methacrylate were used in place of styrene and 2-ethylhexyl methacrylate. The random copolymer had a weight average molecular weight of $6.4\times10^4$.

Preparation Example 1 of Latex Grains: (D-1)

A mixed solution of 10 g of dispersion stabilizing resin P-1, 63.6 g of methyl methacrylate, 36.4 g of methyl acrylate and 400 g of Isopar H was heated to 60° C. with stirring in a nitrogen gas stream. Subsequently, 2.6 g of 2,2'-azobis(2,4-dimethylvaleronitrile) was added thereto, and, after 10 minutes from the addition of the initiator, the mixture became white turbid and the reaction temperature was temporarily raised to 93° C. After reacting for 4 hours, the temperature was elevated to 90° C., the mixture was stirred for 2 hours and unreacted monomers were distilled off. After cooling, a white dispersion passed through 200-mesh nylon cloth was a latex having an average grain size of 0.21 μm with polymerization ratio of 96%. The latex had a good grain size distribution and was uniform in grain size. The white dispersion had a good dispersed state after storage of one month.

Preparation Examples 2 to 10 of Latex Grains: (D-2 to D-10)

Latex grains were prepared in the same manner as in Preparation Example 1 of Latex Grains except that each dispersion stabilizing resin shown in Table C was used in place of the dispersion stabilizing resin P-1 used in Preparation Example 1. The results are shown in Table C. The polymerization ratios of the grains were 85 to 95%, and the latex had a good grain size distribution and was uniform in grain size.

TABLE C

| Preparation Example of Latex | Latex Grains | Dispersion Stabilizing Resin | Average Particle Size of Latex (μm) | Dispersion State* |
|---|---|---|---|---|
| 2 | D-2 | P-2 | 0.38 | good |
| 3 | D-3 | P-3 | 0.23 | " |
| 4 | D-4 | P-4 | 0.35 | " |
| 5 | D-5 | P-5 | 0.26 | " |
| 6 | D-6 | P-6 | 0.22 | " |
| 7 | D-7 | P-7 | 0.15 | " |
| 8 | D-8 | P-8 | 0.37 | " |
| 9 | D-9 | P-9 | 0.30 | " |
| 10 | D-10 | P-10 | 0.24 | " |

*Dispersion state after storage of one month.

PRODUCTION EXAMPLES 1 TO 2 OF COMPARATIVE LATEX GRAINS (S-1) TO (S-2)

Each of the latex grains was produced in the same manner as in Production Example 1 of Latex Grains (D-1) except that each of the comparative dispersion stabilizing resins (R-1) and (R-2) was used in place of Dispersion Stabilizing Resin (P-1). The results obtained are shown in Table D. The polymerization ratio of the respective latex grains was in the range of from 90 to 95%.

TABLE D

| Production Example of Comparative Latex | Latex Grains | Comparative Dispersion Stabilizing Resin | Average Grain Size of Latex (μm) | Dispersed State* |
|---|---|---|---|---|
| 1 | S-1 | R-1 | 3.9 | A large amount of precipitates |
| 2 | S-2 | R-2 | 4.5 | A large amount of precipitates |

* Dispersed state just after preparation of latex grains

In comparison with latex grains (D-1) to (D-10) produced using the dispersion stabilizing resins for the present invention, latex grains (S-1) and (S-2) produced using comparative dispersion stabilizing resins (R-1) and (R-2) were large in grain size, and a large amount of precipitates was observed in the dispersed state. Accordingly, these latex particles could not be used for the liquid developer.

PRODUCTION EXAMPLES 11 TO 14 OF LATEX GRAINS (D-11) TO (D-14)

Each of the latex grains was produced in the same manner as in Production Example 1 of Latex Grains (D-1) except that each of the monomer components shown in Table E was used in place of methyl methacrylate and methyl acrylate in Production Example 1. The results obtained are shown in Table E. The polymerization ratio of the respective latex grains was in the range of from 90 to 95%. The latex had a good size distribution and was uniform in grain size. Also, each of the dispersions showed good dispersion state after storage of one month.

TABLE E

| Production Example of Latex | Latex Grains | Monomer Components | | Average Grain Size of Latex (μm) |
|---|---|---|---|---|
| 11 | D-11 | Methyl methacrylate 53.8 g | Methyl acrylate 46.2 g | 0.19 |
| 12 | D-12 | Methyl methacrylate 70.0 g | Ethyl acrylate 30.0 g | 0.22 |
| 13 | D-13 | Methyl methacrylate 58.7 g | Butyl methacrylate 41.3 g | 0.30 |
| 14 | D-14 | Methyl methacrylate 66.6 g | Methyl acrylate 33.4 g | 0.27 |

PRODUCTION EXAMPLES 15 OF LATEX GRAINS (D-15)

The procedure of Production Example 1 of Latex Grains was repeated except that 1.7 g of dimethylaminoethyl methacrylate in addition to methyl methacrylate and methyl acrylate was used as the monomer component. There was obtained a white dispersion having an average particle size of 0.23 μm with the polymerization ratio of 93%. The latex had a good size distribution and was uniform in grain size. Also, each of the dispersions showed good dispersion state after storage of one month.

Production Examples 4 to 6 of Comparative Latex Grains (S-4 to S-6)

Latex grains were prepared in the same manner as in Production Example 1 of Latex Grains except that monomer components shown in Table F were used in place of methyl methacrylate and methyl acrylate used in Production Example 1. The results are shown in Table F. The polymerization ratios of the grains were 90 to 95%.

EXAMPLE 1

Resin dispersion (D-i) produced in Production Example 1 of Latex Grains was diluted with Isopar H so as to give a resin content of 5 g/liter. Zirconium naphthenate was added thereto as a charge controlling agent in an amount of $1\times10^{-5}$M to prepare a positive charge liquid developer, and, then, the charge amount of the resulting developer was measured.

The charge amount was measured using an equipment for measuring electrophoretic characteristics of liquid developer as described in JP-β-64-696. (The charge amount was measured by determining the initial differential calculus of the voltage variation with time induced on the back surface of the electrode at the applied voltage of 500 V.)

The above-prepared liquid developer showed a definite positive charge of 125 mV, and also the amount of charge thereof was found to be easily controlled by adjusting the amount of the charge controlling agent.

Comparative Developers A and B

Liquid developers A and B for comparison were prepared in the same manner as in the preparation of the liquid developer described above except that each of the following resin dispersions were used in place of the resin dispersion used above.

Comparative liquid developer A:

The resin dispersion (S-5) prepared in Comparative Latex Particle Preparation Example 5.

Comparative liquid developer B:

The resin dispersion (S-6) prepared in Comparative Latex Particle Preparation Example 6.

Using these developers, the following printing plate precursor positively charged with a corona charger was imagewise exposed and reverse developed according to a conventional method. The plate was heated at 120° C. for 10 minutes to fix the image.

This printing plate precursor was immersed in an etching solution prepared by diluting 40 parts of potassium silicate, 10 parts of potassium hydroxide, 20 parts of benzyl alcohol and 20 parts of ethanol with 900 parts of water to remove the non-image areas, and then thoroughly washed with water.

The resolving power of the resulting plate was measured, thereby evaluating the resist property of the toner image areas. The results obtained are also shown in Table G.

TABLE F

| Production Example of Latex Grains Comp. Ex. | Latex Grains | Monomer Component | | Average Grain Size of Latex (μm) | Dispersion State |
|---|---|---|---|---|---|
| 4 | S-4 | Methyl methacrylate 100 g | | 0.16 | pudding-like agglomeration |
| 5 | S-5 | Methyl methacrylate 47.9 g | Lauryl methacrylate 52.1 g | 0.34 | good |
| 6 | S-6 | Methyl methacrylate 54.2 g | Stearyl methacrylate 45.8 g | 0.27 | good |

TABLE G

| Example | Developer | Resolving Power (lines/mm) | Stability of Developer* |
|---|---|---|---|
| Example 1 | Developer of Example 1 | 38 to 40 | Good |
| Comparative Example A | Developer A | 2 to 4 | Good |
| Comparative Example B | Developer B | 1 to 2 | Good |

*Dispersed state after left to stand for one month for storage

The above results indicate that the developers using comparative dispersion resin grains show good dispersion stability, but show poor resolving power due to weak resistivity to the etching solution.

Preparation of Printing Plate Precursor

The following coating solution for photoconductive layer was coated on a sand grained anodized aluminum sheet by means of a bar coater, and dried at 120° C. for 10 minutes to prepare the printing plate precursor with a coated film thickness of 3.0 μm.

| Coating solution for photoconductive layer | |
|---|---|
| 1. X type metal-free phthalocyanine | 15 parts |
| 2. Copolymer of benzyl methacrylate with methacrylic acid (methacrylic acid: 40 mol %) | 139 parts |
| 3. Thiobarbituric acid derivative of the following formula | 1.6 parts |

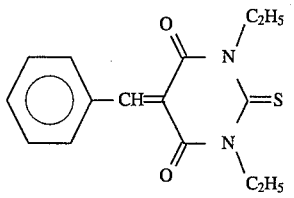

| | |
|---|---|
| 4. 1-Methoxy-2-propanol | 444 parts |
| 5. Methyl ethyl ketone | 666 parts |

A mixture having the above composition was uniformly dispersed (dispersion residence time: one hour) in dyno mill (KDL) to prepare the coating solution for photoconductive layer. The viscosity of the coating solution: 90 cps (ELD viscometer)

EXAMPLE 2

The procedure of Example 1 was repeated except that latex grains shown in Table H were used in place of the white resin dispersion prepared in Preparation Example 1 of Latex Grains, and an octadecene-half maleic acid octadecylamide copolymer as a charge controlling agent was added in an amount of 0.01 g of the copolymer per liter of Isopar H to obtain each of liquid developers.

In the same manner as in Example 1, the printing plate precursor was exposed, developed by using these liquid developers and etched. The property as the resist of the plate was evaluated. Further, 3000 plates of the printing plate precursors were subjected to the above processing, and staining caused by the adhesion of toner to the developing apparatus was evaluated. The results are shown in Table H.

TABLE H

| Example | Latex Grains | Resolving Power (lines/mm) | Staining of Developing Apparatus | Stability* of Developer |
|---|---|---|---|---|
| 2 | D-2 | 36 to 40 | No staining | good |
| 3 | D-3 | 34 to 42 | " | " |
| 4 | D-4 | 37 to 40 | " | " |
| 5 | D-5 | 38 to 40 | " | " |
| 6 | D-6 | 30 to 40 | " | " |
| 7 | D-7 | 35 to 39 | " | " |
| 8 | D-8 | 31 to 36 | " | " |
| 9 | D-9 | 36 to 40 | " | " |
| 10 | D-10 | 35 to 40 | " | " |
| 11 | D-11 | 40 to 42 | " | " |
| 12 | D-12 | 38 to 40 | " | " |
| 13 | D-13 | 35 to 38 | " | " |
| 14 | D-14 | 33 to 36 | " | " |

*Dispersed state after left to stand for one month for storage

It is apparent from Table H that the liquid developers of the present invention were excellent in the property as the resist and dispersion stability and did not cause staining by the adhesion of the toner to the developing apparatus. Further, images on the resulting printing plate were clear, and images on prints after printing 10,000 prints were very clear.

According to the present invention, toner images having resist with high fastness to etching solutions can be formed, and liquid developers which are excellent in dispersion stability and which can be used and stored over a long period of time can be obtained.

Further, staining by the adhesion of toner to the developing apparatus is not caused. Accordingly, the maintenance of the apparatus can be easily made. Further, liquid developers which give images having excellent resolving power and are excellent in image reproducibility can be obtained.

While the invention has been described in detail and with reference to specific embodiments thereof, it will be apparent to one skilled in the art that various changes and modifications can be made therein without departing from the spirit and scope thereof.

What is claimed is:

1. A liquid developer useful for developing a latent image having been electrophotographically formed on a printing plate precursor into a toner image during manufacture of a printing plate, said printing plate precursor comprising an electrically conductive substrate having a hydrophilic surface and a layer containing an organic photoconductive compound on said hydrophilic surface, said toner image being fixed, and a non-image area of said layer other than said toner image area being removed by etching with an alkaline etching solution to provide said printing plate, said liquid developer comprising at least resin grains dispersed in a non-aqueous solvent having a volume specific resistivity of at least $10^9$ Ωcm, wherein said resin grains are obtained by polymerizing (a) at least one monomer selected from the group consisting of methyl methacrylate and ethyl methacrylate soluble in the non-aqueous solvent, and (b) at least one monomer selected from the group consisting of alkyl acrylate having an alkyl group of up to 4 carbon atoms and butyl methacrylate, said alkyl acrylate and butyl methacrylate being soluble in the non-aqueous solvent but which become insoluble therein upon being polymerized, in the presence of a dispersion stabilizing resin which is dissolved or dispersed in a colloidal form in the non-aqueous solvent and which comprises a graft copolymer composed of (1) at least one macromonomer (M) having a weight average molecular weight of from $1\times10^3$ to $1\times10^5$ and having a polymerizable double bond group represented by the general formula (II) below bonded at a terminal of the main chain of a polymer composed of at least one of a styrene polymer component and a polymer component represented by the general formula (I) described below, and (2) at least one monomer represented by the general formula (III) below;

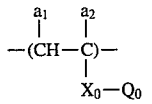

(I)

wherein $X_0$ represents at least one linking group selected from the group consisting of —COO—, —OCO—, —$CH_2)_k$—OCO—, —$(CH_2)_k$—COO—, —O—, —CONH-COO—, —CONHCO—, —$SO_2$— CO—,

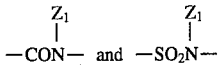

(wherein $Z_1$ represents a hydrogen atom or a hydrocarbon group, and k represents an integer of 1 to 3); $a_1$ and $a_2$, which may be the came or different, each represents a hydrogen atom, a halogen atom, a cyano group, a hydrocarbon group, —COO—$Z_2$ or —COO—$Z_2$ bonded via a hydrocarbon group (wherein $Z_2$ represents a hydrogen atom or a hydrocarbon group which may be substituted); and $Q_0$ represents an aliphatic group having from 1 to 3 carbon atoms;

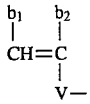

(II)

wherein V represents —COO—, —OCO—, —$(CH_2)_k$—OCO—, —$(CH_2)_k$—COO—, —O—, —CONHCOO—, —CONHCO—, —$SO_2$—, —CO—,

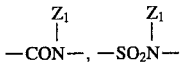

or a phenylene group (wherein $Z_1$ represents a hydrogen atom or a hydrocarbon group, and k represents an integer of 1 to 3); $b_1$ and $b_2$, which may be the same or different, have the same meanings as $a_1$ and $a_2$ defined in the general formula (I); and

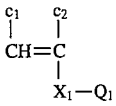

(III)

wherein $X_1$ has the same meaning as $X_0$ defined in the general formula (I), $Q_1$ represents an aliphatic group having from 4 to 22 carbon atoms, and $c_1$ and $c_2$, which may be the same or different, have the same meanings as $a_1$ and $a_2$ defined in the general formula (I).

2. The liquid developer as in claim 1, wherein said resin grains are resin grains obtained by polymerizing (a) at least one monomer selected from the group consisting of methyl methacrylate and ethyl methacrylate, (b) at least one monomer selected from the group consisting of alkyl acrylate having an alkyl group of up to 4 carbon atoms and butyl methacrylate, and (c) at least one vinyl monomer having a basic nitrogen atom or an amido group, in the presence of said dispersion stabilizing resin.

3. The liquid developer as in claim 2, wherein said vinyl monomers having a basic nitrogen atom or an amido group are vinyl monomers selected from the group consisting of aminoalkyl-substituted (meth)acrylates represented by the following formula (IV), quaternary salts of aminoalkyl-substituted (meth)acrylates represented by the following formula (V), N-vinylimidazole, N-vinyl-2-methylimidazole, 1-vinylpyrrole, N-β-acryloxyethylindole, 2-vinylquinoline, 4-vinylpyridine, 5-vinyl-4-methylthiazole, 3-methyl-5-isopropenylpyrazole, N-vinyl-2-pyrrolidone, N-vinylpiperidone, N-vinyloxazolidone, dimethylaminostyrene, dialkylaminomethylstyrenes, quaternary salts of dialkylaminomethylstyrenes and (meth)acrylamide;

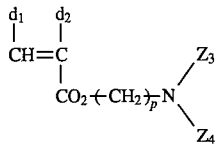

(IV)

wherein $d_1$ and $d_2$, which may be the same or different, each represents a hydrogen atom or a methyl group, $Z_3$ and $Z_4$, which may be the same or different, each has the same meaning as $z_1$, and p represents an integer of 1 to 3;

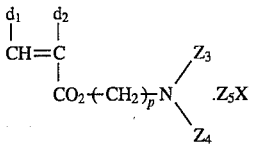

(V)

wherein $d_1$, $d_2$, p, $Z_3$ and $Z_4$ are as defined in the general formula (IV) above, $Z_5$ represents an alkyl group having 1 to 18 carbon atoms or an aralkyl group having 7 to 24 carbon atoms, and X represents a halogen atom, an acetate, $BF_4$, a sulfate, p-toluenesulfonate or an alkylsulfonate.

4. The liquid developer as in claim 2, wherein said monomer component (c) comprises not more than 30 mol % based on the total amount of monomers (a), (b) and (c).

5. The liquid developer as claimed in claim 2, wherein said (b) at least one monomer selected from the group consisting of alkyl acrylate having an alkyl group of up to 4 carbon atoms and butyl methacrylate is present in an amount of 0.1 to 9 mol per mol of said (a) at least one monomer selected from methyl methacrylate or ethyl methacrylate.

6. The liquid developer for electrostatic photography as in claim 1, wherein the liquid developer further contains a coloring agent.

* * * * *